United States Patent [19]

Leskinen et al.

[11] 4,285,635

[45] Aug. 25, 1981

[54] IMPELLER IN A CENTRIFUGAL BLOWER

[75] Inventors: Seppo J. Leskinen, Västerskog; Olli J. Pukkila, Helsinki, both of Finland

[73] Assignee: Oy Mercantile AB, Helsinki, Finland

[21] Appl. No.: 61,302

[22] Filed: Jul. 27, 1979

[30] Foreign Application Priority Data

Aug. 23, 1978 [FI] Finland ..... 782579

[51] Int. Cl.[3] ..... F04D 29/26; B21K 1/28

[52] U.S. Cl. ..... 416/185; 29/156.8 CF; 74/572; 113/116 D; 416/DIG. 3

[58] Field of Search ..... 416/178, 185, 186, 187, 416/244 R, 244 A, 184, DIG. 3, 182, 213 R, 213 A; 29/156.8 CF, 156.8 R; 74/448, 449, 572; 113/116 D; 228/182

[56] References Cited

U.S. PATENT DOCUMENTS

| | | | |
|---|---|---|---|
| 1,096,631 | 5/1914 | Kortum | 113/116 D |
| 1,447,915 | 3/1923 | Watkins | 416/186 |
| 2,224,617 | 12/1940 | Sylvan | 416/187 |
| 2,506,641 | 5/1950 | Hoover | 74/449 |

FOREIGN PATENT DOCUMENTS

| | | | |
|---|---|---|---|
| 589468 | 1/1978 | U.S.S.R. | 416/184 |

*Primary Examiner*—Leonard E. Smith

*Attorney, Agent, or Firm*—Dressler, Goldsmith, Shore, Sutker & Milnamow, Ltd.

[57] ABSTRACT

Disclosed is a centrifugal-blower impeller, which consists of a center part and radially outer part, which has a smaller thickness of material than the center part. The outer part consists of ring segments attached by welding to the periphery of the center part. The ring segments are first welded to the center part and thereafter radially to each other so that the ring segments are subject to tensile stress and the center part to compressive stress.

3 Claims, 4 Drawing Figures

IMPELLER IN A CENTRIFUGAL BLOWER

BACKGROUND OF THE INVENTION

The present invention relates to an impeller in a centrifugal blower, the front and/or back plate of the impeller being made up of a center part and a radially outer part attached to it and having a material thickness smaller than that of the center part. The front and back plates of the impeller are plate disks. In rotating plate disks, stresses increase towards the hub. The stresses are tensile. Obtaining a disk of even strength by reducing its thickness towards the periphery is previously known. Likewise, the manufacture of impellers by welding is part of current technology. Furthermore, prestressing of structures is used in both construction technology and mechanical engineering, as is also prestressing by means of welding. It is also known that different stresses prevail in different parts of the impeller of a blower, and owing to the aerodynamic form it has not been possible entirely to even out these stresses by varying the thickness of material. Prestressing of the structure is in this case the only usable method by which stress peaks can be lowered. Several attempts have been made. In one structure the front plate is tied to the hub by means of tensing bars, which are prestressed. The characteristics that attempts of this type have in common is that they require additional parts which result in additional costs, limit the blower's uses and lower the performance of the blower. In the case mentioned, the tensing bars increase the noise produced by the blower and lower its efficiency. The lowering of stress peaks achieved by these means is quite modest.

SUMMARY OF THE INVENTION

The present invention eliminates the above disadvantages. The characteristics of the invention are given in the accompanying claim.

The technical solution according to the invention combines, in a novel and original manner, the techniques known per se. Four substantial advantages are gained by dividing the outer ring (rings) into segments:

1. Prestressing of the structure is possible without affecting the performance of the blower.

2. The prestressing can be performed without increasing the manufacturing cost. No additional parts are required, and the welding costs do not increase immoderately, since rather large impellers in particular must usually be made from several parts in any case. On the other hand, owing to the division into segments, the waste of material can be reduced to such an extent that the total costs are even lowered, especially when using material more expensive than normal steel.

3. As an additional advantage of the prestressing of the impeller the outer part of the front and back plates can simultaneously be made lighter. Owing to the high manufacturing costs the general use of this structure, known to be advantageous, has not been possible in blowers.

4. Prestressing can be performed within the framework of normal production without separate tools, measuring devices, etc. The method is highly secure in terms of manufacturing techniques. There is no risk of a release of the prestressing by the loosening of the tightening members, for example.

If the outer parts of the disk are assembled from ring segments which are welded to the center part and thereafter radially to each other, a tensile stress is produced in the ring segments and a compressive stress in the center part. By a suitable selection of the number of joints and the thicknesses of material, it is possible, by conventional welding techniques, to construct impellers which have a constant stress throughout the front and back plates during operation. This allows considerably higher peripheral velocities and pressures than those achieved using non-prestressed impellers.

BRIEF DESCRIPTION OF THE DRAWINGS

One preferred embodiment of the invention is described below with reference to the accompanying drawing, but without limiting the invention to this embodiment.

DESCRIPTION OF A PREFERRED EMBODIMENT

Figure 2:
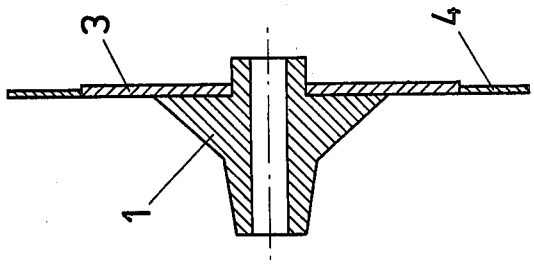
FIG. 1 of the drawing depicts the back plate of the impeller as a plane representation and FIG. 2 depicts a sectioned side view of this plate.
Figure 1:
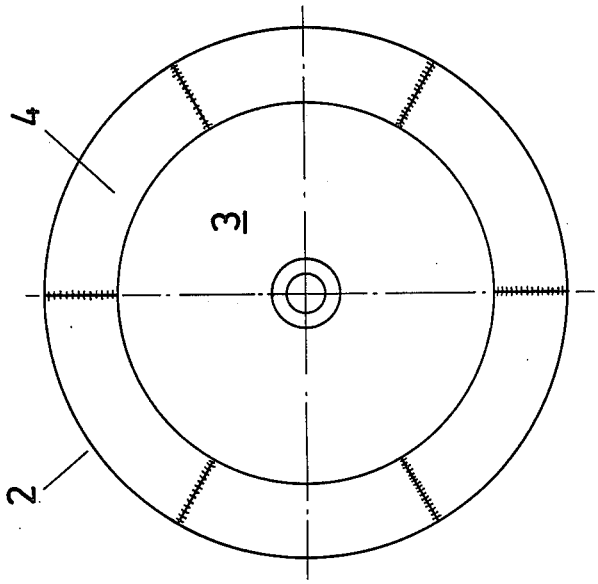

The ring segments 4 have first been attached by welding to the periphery of the center part 3 of the back plate mounted on the hub 1 of the impeller according to FIGS. 1 and 2. Thereafter these ring segments 4 have been welded radially to each other, and thus tensile stress is effective in the ring segments 4 and compressive stress in the center part 3.

Figure 3:
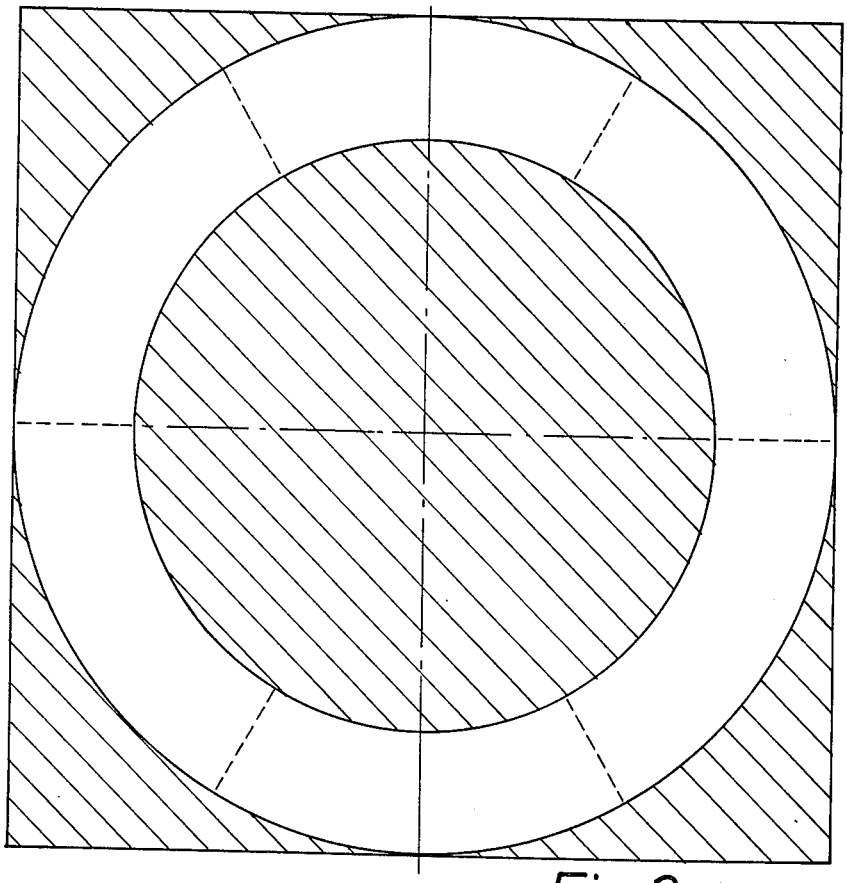
FIG. 3 depicts the waste material produced in the manufacture of a known outer ring of the impeller.
Figure 4:
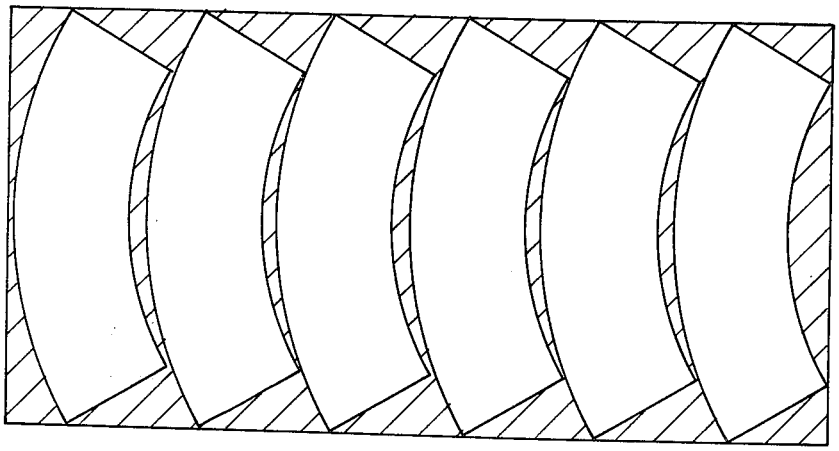
FIG. 4 depicts the waste material produced in the manufacture of ring segments according to the invention.

The shading in FIG. 3 shows the waste material produced in the manufacture of a prior known whole outer ring of an impeller, and the shading in FIG. 4 shows the water material produced in the manufacture of ring segments according to the invention, the waste being considerably less than in the case of FIG. 3.

What is claimed is:

1. In a impeller for centrifugal blower including a back plate having a center part and a radial outer part whose material thickness is smaller than said center part, a method of forming said back plate comprising the steps of: forming said outer part from a plurality of ring segments; welding said ring segments to said center part; and welding said ring segments radially to each other such that said center part is subjected to compressive stress.

2. In a centrifugal-blower impeller having a back plate with a center part and a radially disposed outer part whose material thickness is smaller than said center part, an outer part, comprising: ring segments attached by welding to the periphery of said center part, said ring segments being first welded to said center part and thereafter radially to each other so as to subject said ring segments to tensile stress and said center part to compressive stress, whereby a prestressed back plate is formed which allows said impeller to be rotated at a higher peripheral velocity and to be subjected to greater pressure than an impeller whose back plate was formed from a single annular outer part which was simply welded to such center part.

3. A method of fabricating a prestressed back plate for an impeller of the type having a hub joined to a circular center part, and an outer part which is joined to the periphery of the center part and which has a thickness less than that of the center part, comprising the steps of:

(a) forming a plurality of similar ring segments from a generally rectangular plate whose width is generally equal to the length of the cord disposed along the periphery of each ring segment, and whose length is generally equal to the sum of the widths of the ring part so as to minimize the waste of material;

(b) attaching said ring segments by welding to the periphery of said center part; and (c) attaching corresponding adjoining ends of said ring segments to each other in such a manner that the ring segments are placed in tension relative to each other and that said center part is subjected to a compressive stress due to said joined together ring segments, whereby said back plate can be rotated at a greater peripheral speed than a back plate fabricated from a single outer part.

* * * * *